US011585626B2

(12) United States Patent
Larson

(10) Patent No.: US 11,585,626 B2
(45) Date of Patent: Feb. 21, 2023

(54) ADJUSTABLE TWO-PIECE ARCHERY QUIVER

(71) Applicant: Black Gold Archery, LLC, Belgrade, MT (US)

(72) Inventor: Phillip S. Larson, Belgrade, MT (US)

(73) Assignee: BLACK GOLD ARCHERY, LLC, Belgrade, MT (US)

( * ) Notice: Subject to any disclaimer, the term of this patent is extended or adjusted under 35 U.S.C. 154(b) by 0 days.

(21) Appl. No.: 17/088,496

(22) Filed: Nov. 3, 2020

(65) Prior Publication Data

US 2022/0136793 A1 May 5, 2022

(51) Int. Cl.
*F41B 5/06* (2006.01)

(52) U.S. Cl.
CPC ..... *F41B 5/066* (2013.01)

(58) Field of Classification Search
CPC ..... F41B 5/06; F41B 5/066; Y10S 224/916
USPC ..... 124/25.7, 86, 88; 224/916
See application file for complete search history.

(56) References Cited

U.S. PATENT DOCUMENTS 2,980,305 A * 4/1961 Reese ..... F41B 5/066 124/25.7
2,999,620 A * 9/1961 Haggard ..... F41B 5/066 124/25.7
3,108,725 A * 10/1963 Ramsey ..... F41B 5/066 124/25.7
3,116,730 A * 1/1964 Tingley ..... F41B 5/066 224/916
3,209,740 A * 10/1965 Hauch ..... F41B 5/066 124/25.7
3,366,101 A * 1/1968 Saunders ..... F41B 5/066 124/25.7
3,465,928 A * 9/1969 Osterholm ..... F41B 5/063 124/25.7
3,490,662 A * 1/1970 Ramsey ..... F41B 5/066 124/25.7
3,591,062 A * 7/1971 Karbo ..... F41B 5/066 124/25.7
3,595,214 A * 7/1971 O'Malley ..... F41B 5/066 124/90
3,716,174 A * 2/1973 Ehlert ..... F41B 5/066 124/25.7
3,946,718 A * 3/1976 Garman ..... F41B 5/066 224/916
4,020,984 A * 5/1977 Morris ..... F41B 5/066 124/25.7

(Continued)

*Primary Examiner* — Alexander R Niconovich
(74) *Attorney, Agent, or Firm* — Husch Blackwell LLP

(57) ABSTRACT

An archery quiver includes upper and lower quiver assemblies. Each quiver assembly includes corresponding arrow retainer and mounting assembly connecting the arrow retainer to the riser. The arrow retainers retain the arrows stored in the quiver. Each quiver assembly holds its corresponding arrow retainer substantially rigidly attached to the riser in a position adjustable over different longitudinal positions, different transverse positions, or both. One or both arrow retainers can be adjustable over different vertical positions. The upper and lower arrow retainer positions can be adjustable independently of one another. The upper and lower quiver assemblies can comprise separate assemblies that are attached independently to the riser at distinct corresponding locations on the riser.

21 Claims, 14 Drawing Sheets

(56) References Cited

U.S. PATENT DOCUMENTS

| | | | | | |
|---|---|---|---|---|---|
| 4,607,606 | A * | 8/1986 | Schaar | F41B 5/066 | 224/916 |
| 4,685,438 | A * | 8/1987 | Larson | F41B 5/066 | 124/25.7 |
| 4,995,372 | A * | 2/1991 | Topel | F41B 5/066 | 124/25.7 |
| 5,265,584 | A * | 11/1993 | Judson | F41B 5/066 | 124/25.7 |
| 5,775,313 | A * | 7/1998 | Bresette | F41B 5/1453 | 124/25.7 |
| 6,105,566 | A * | 8/2000 | Tiedemann | F41B 5/066 | 124/25.7 |
| 6,330,881 | B1 * | 12/2001 | Pippard | F41B 5/10 | 124/25.7 |
| 6,390,085 | B1 * | 5/2002 | Stinson | F41B 5/066 | 124/25.7 |
| 6,672,299 | B2 * | 1/2004 | Proctor | F41B 5/066 | 224/916 |
| 6,725,853 | B2 * | 4/2004 | Foddrill | F41B 5/066 | 224/916 |
| 7,980,239 | B1 * | 7/2011 | Parmer, Sr. | F41B 5/066 | 124/25.7 |
| 8,006,682 | B2 * | 8/2011 | Vanek | F41B 5/066 | 124/25.5 |
| 8,714,147 | B2 * | 5/2014 | Walk | F41B 5/066 | 224/916 |
| 8,839,773 | B2 * | 9/2014 | Ellig | F41B 5/066 | 124/88 |
| 9,372,045 | B1 * | 6/2016 | Kempf | F41B 5/066 | |
| 2011/0277739 | A1 * | 11/2011 | Blais | F41B 5/14 | 124/25.7 |

* cited by examiner

ADJUSTABLE TWO-PIECE ARCHERY QUIVER

FIELD OF THE INVENTION

The field of the present invention relates to archery quivers. In particular, an adjustable two-piece archery quiver is disclosed.

BACKGROUND

Some examples of archery quivers are disclosed in:

U.S. Pat. No. 6,672,299 entitled "Archery quiver" issued Jan. 6, 2004 to Proctor;

U.S. Pat. No. 8,714,147 entitled "Modular quiver apparatus and method" issued May 6, 2014 to Walk et al;

U.S. Pat. No. 8,839,773 entitled "Quiver" issued Sep. 23, 2014 to Ellig; Each of those patents is incorporated by reference in its entirety.

SUMMARY

An inventive archery quiver comprises upper and lower quiver assemblies. The upper quiver assembly includes an upper arrow retainer and an upper mounting assembly connecting the upper arrow retainer to the riser; the lower quiver assembly includes a lower arrow retainer and a lower mounting assembly connecting the lower arrow retainer to the riser. The upper and lower arrow retainers retain each one of multiple arrows stored in the quiver. Each quiver assembly holds its corresponding arrow retainer substantially rigidly attached to the riser in a position relative to the riser that is adjustable over corresponding ranges of different longitudinal positions, corresponding ranges of different transverse positions, or both. One or both arrow retainers can in some instances be adjustable over corresponding ranges of different vertical positions relative to the riser. The upper and lower arrow retainer positions can be adjustable independently of one another. The upper and lower quiver assemblies can comprise separate assemblies that are attached independently to the riser at distinct corresponding locations on the riser.

Objects and advantages pertaining to archery quivers may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The embodiments depicted are shown only schematically; all features may not be shown in full detail or in proper proportion; for clarity certain features or structures may be exaggerated or diminished relative to others or omitted entirely; the drawings should not be regarded as being to scale unless explicitly indicated as being to scale. The embodiments shown are only examples and should not be construed as limiting the scope of the present disclosure or appended claims.

DETAILED DESCRIPTION

Figure 1A:
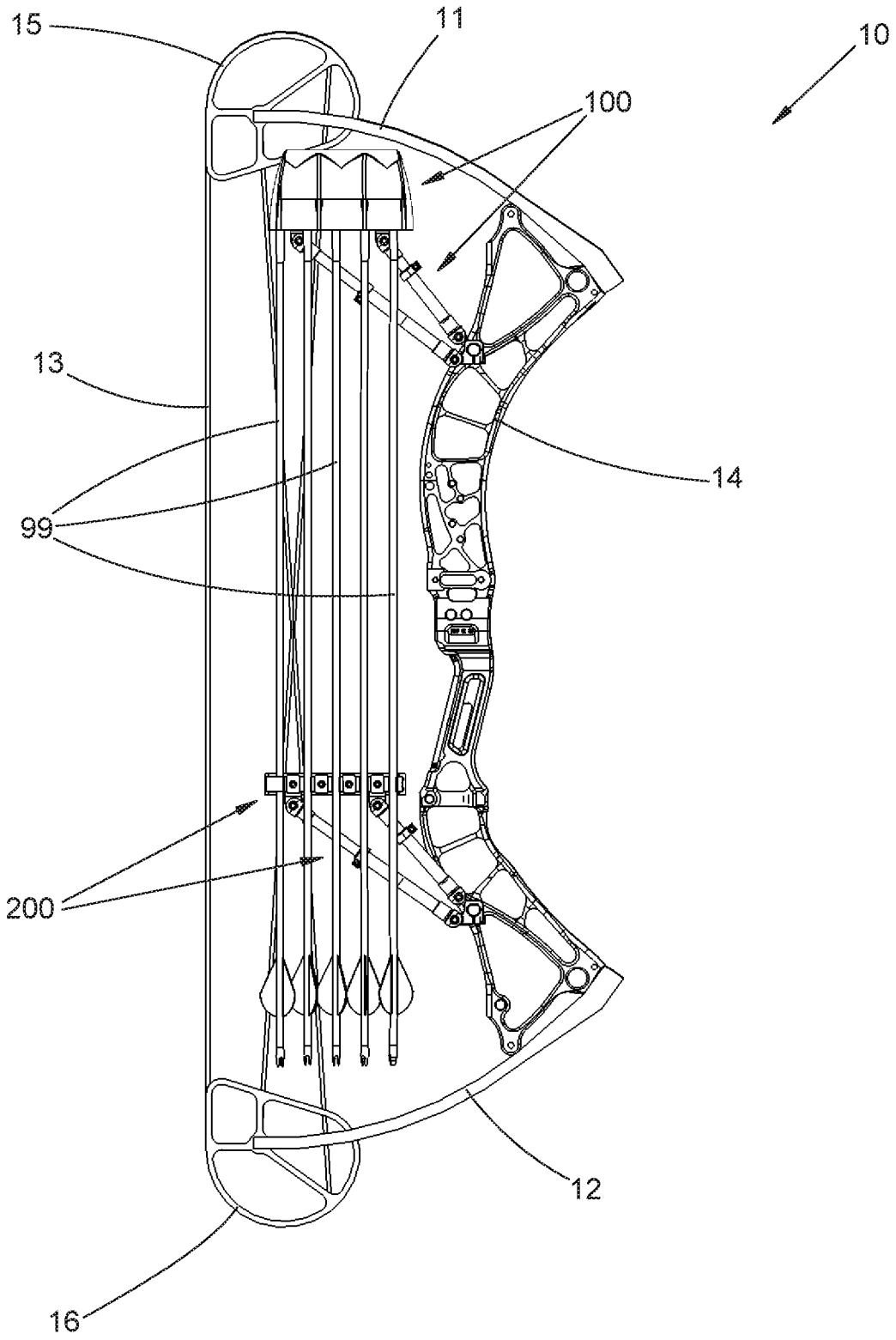
FIGS. 1A, 1B, and 1C are side, back, and isometric views, respectively, of an example of an archery quiver mounted on an archery bow and holding multiple arrows.
Figure 1B:
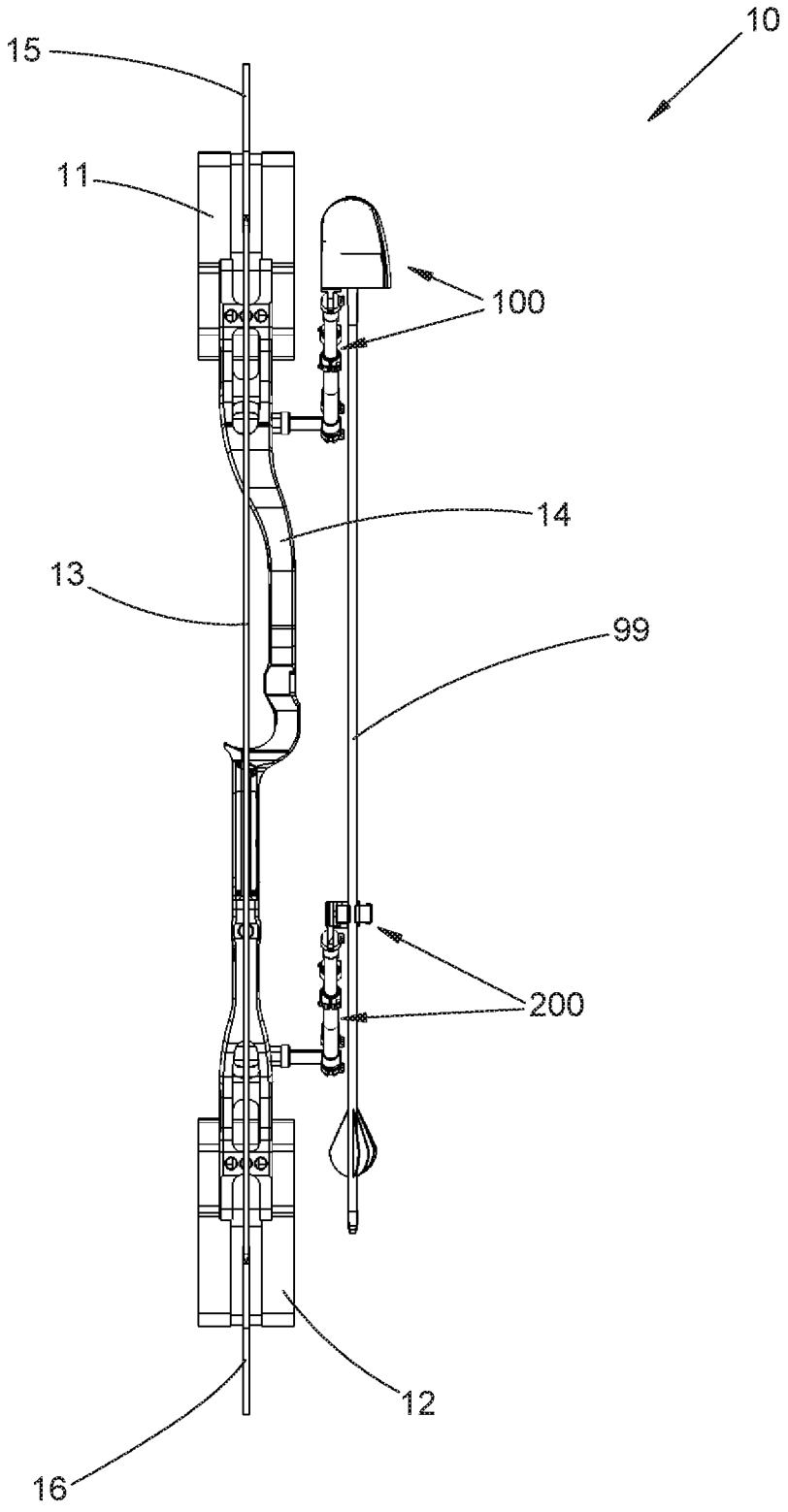
Figure 1C:
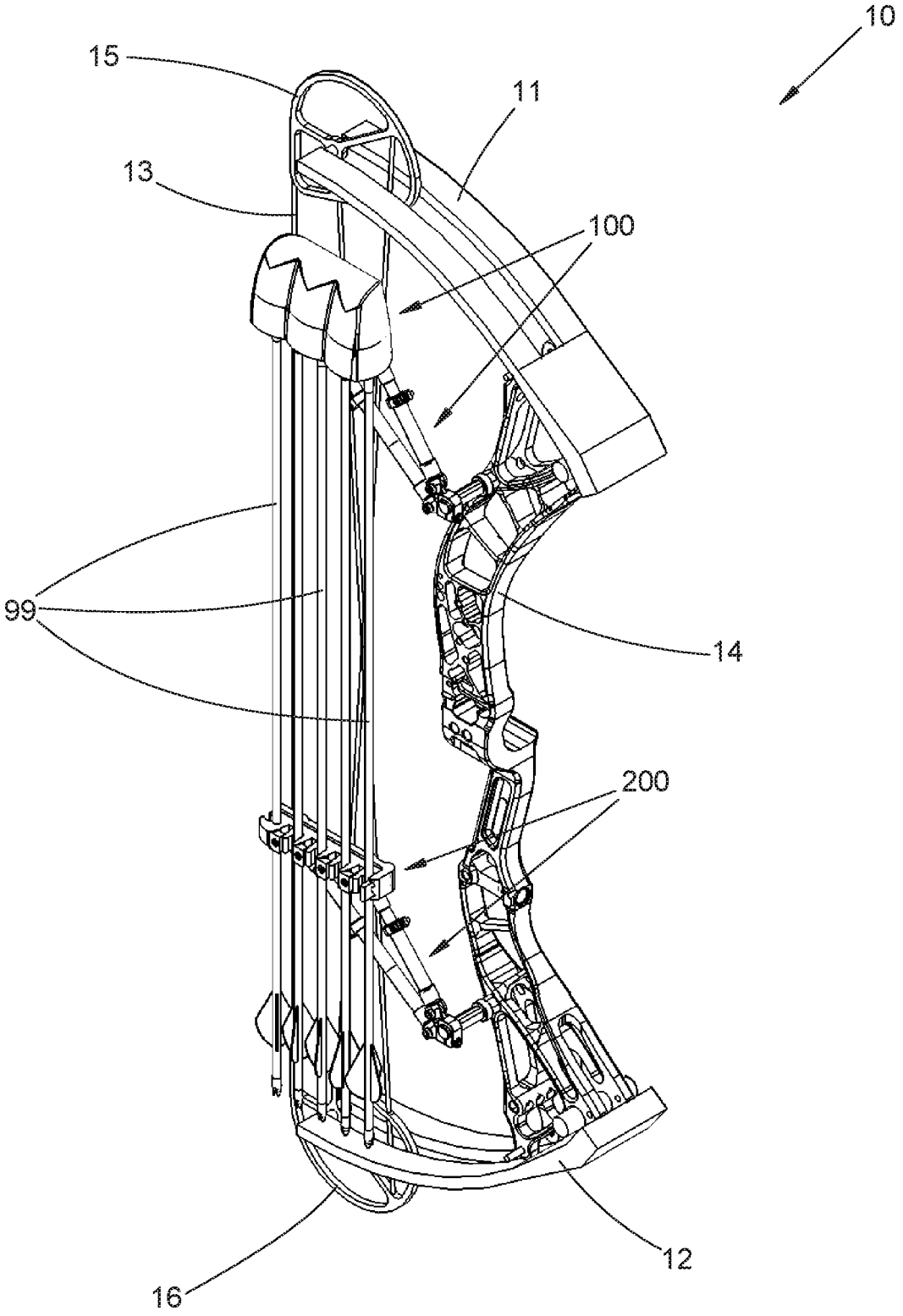
Figure 2A:
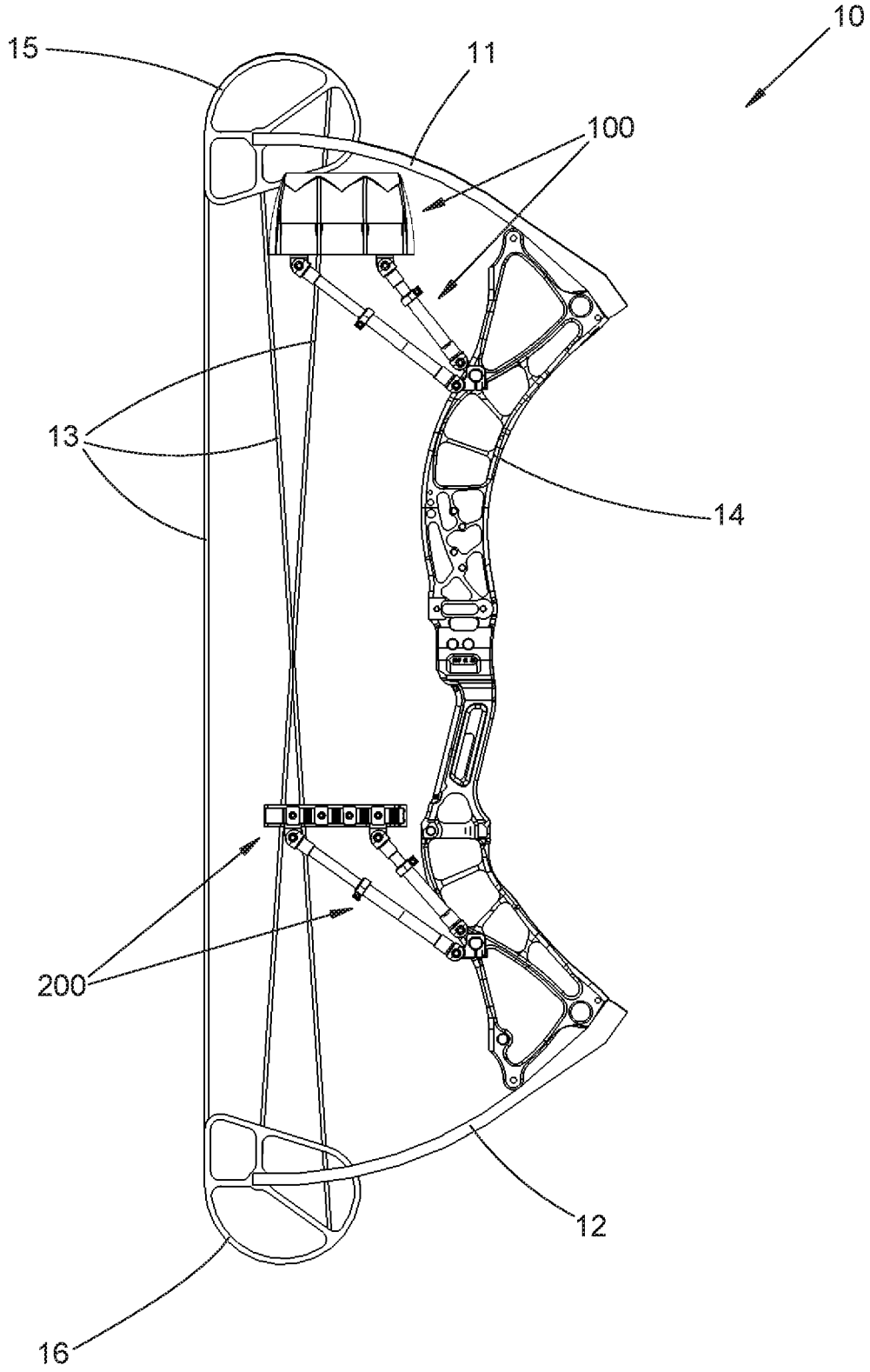
FIGS. 2A, 2B, and 2C are side, back, and isometric views, respectively, of the quiver and bow of FIGS. 1A and 1B with the arrows and rigging removed.
Figure 2B:
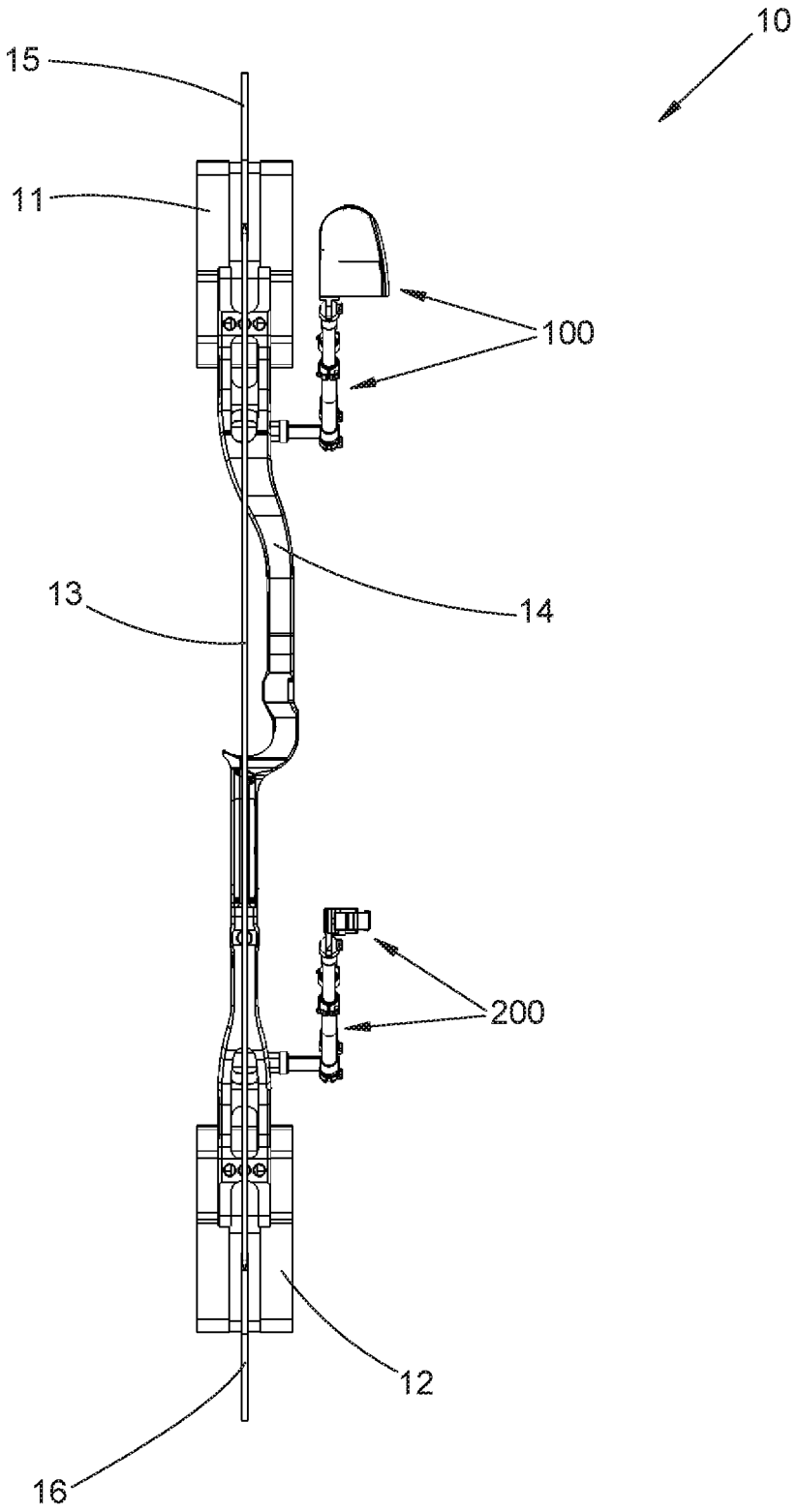
Figure 2C:
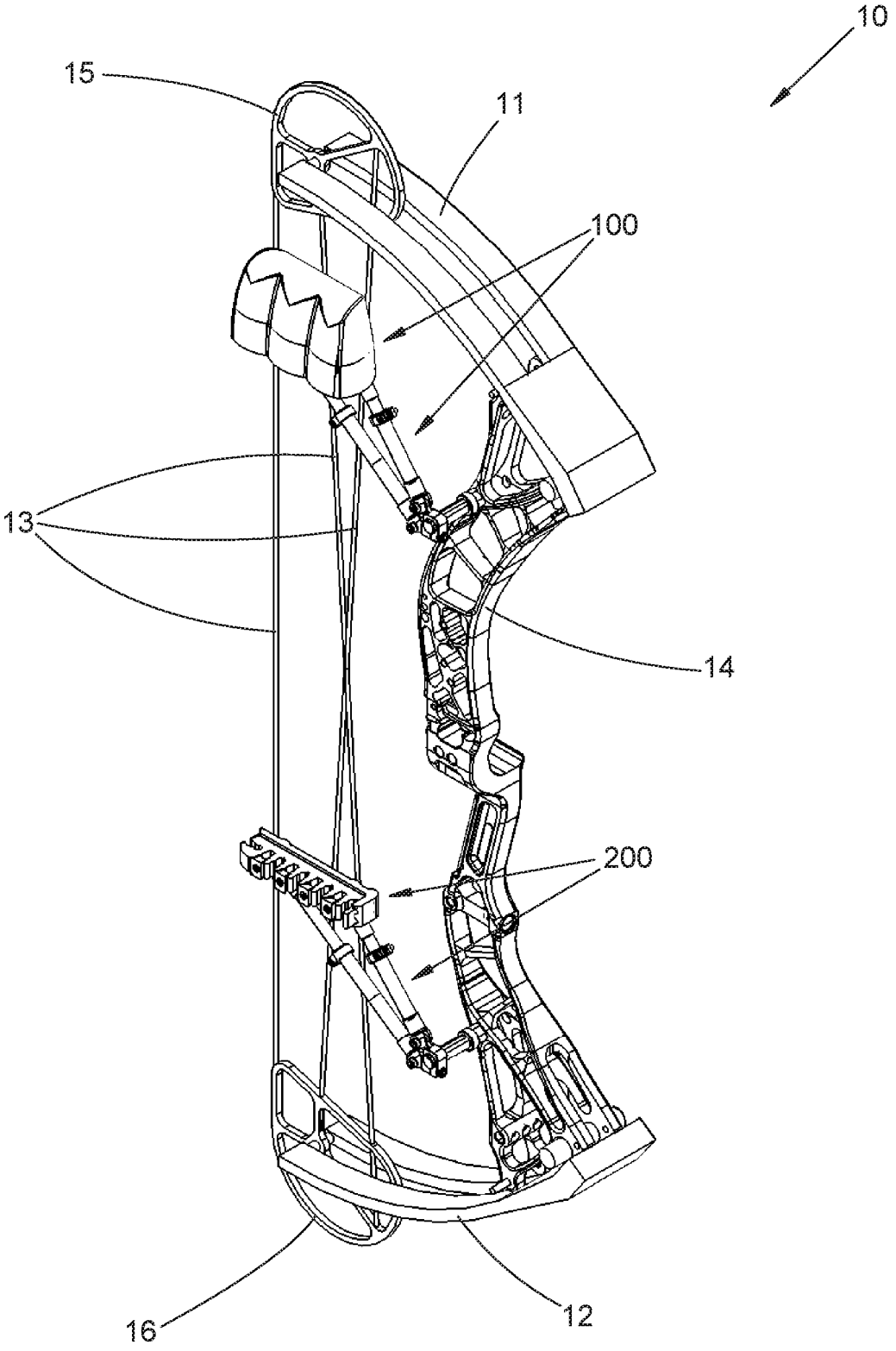

FIGS. 1A, 1B, and 1C show an example of a two-piece adjustable quiver mounted on an archery bow 10 and holding multiple arrows 99. In the examples shown the bow 10 is a compound bow that includes various pulleys and cables; the disclosed quiver can be used with any suitable type of bow, including compound bows. FIGS. 2A, 2B, and 2C show the quiver and bow 10 with the arrows 99 removed. The bow 10 includes a riser 14, upper and lower bow limbs 11 and 12, upper and lower pulleys 15 and 16, and various cables 13. The quiver includes an upper quiver assembly 100 and a lower quiver assembly 200. Typically, but not necessarily, the upper and lower quiver assemblies 100 and 200 comprise separate assemblies that are attached independently to the riser 14 at distinct corresponding locations thereon.

The upper quiver assembly 100 includes an upper arrow retainer 110 and an upper mounting assembly 120 connecting the upper arrow retainer 110 to the riser 14. The lower quiver assembly 200 includes a lower arrow retainer 210 and a lower mounting assembly 220 connecting the lower arrow retainer 210 to the riser 14. The arrow retainers 110 and 210 together hold the one or more arrows 99 stored in the quiver, and can be of any suitable type or arrangement. The upper and lower quiver assemblies 100 and 200 are each structurally arranged so that the corresponding upper and lower arrow retainers 110 and 210 are substantially rigidly attached to the riser 14 and held at corresponding upper and lower arrow retainer positions relative to the riser 14.

The position of the upper arrow retainer 110 is adjustable over a corresponding range of different longitudinal positions or a corresponding range of different transverse positions relative to the riser 14; in some examples, the upper arrow retainer position is adjustable over corresponding ranges of both longitudinal and transverse positions. Similarly, the position of the lower arrow retainer 210 is adjustable over a corresponding range of different longitudinal positions or a corresponding range of different transverse positions relative to the riser 14; in some examples, the lower arrow retainer position is adjustable over corresponding ranges of both longitudinal and transverse positions. In some examples, the position of one or both arrow retainers 110 or 210 can be adjusted over a corresponding range of vertical positions relative to the riser 14. Typically, but not necessarily, the positions of the upper and lower arrow retainers 110 and 210 can be adjusted independently of one another.

The adjustment of the arrow retainer positions provides several new and useful results. Adjustment of transverse position (i.e., movement perpendicular to the shooting plane defined by movement of the draw cable of the bow during draw and release) enables the adjustable quiver to be positioned as close as desired to the shooting plane (e.g., so as to reduce uneven transverse weight distribution) while still allowing clearance of various cables, limbs, or pulleys of the bow 10, or accessories such as an arrow rest or bow sight. That adjustment makes the adjustable quiver usable with a wider variety of different bows. The transverse position can be adjusted for any other reason, including user preference. Adjustment of longitudinal position (i.e., movement parallel to arrow flight) enables the adjustable quiver to be positioned for optimized or user-preferred fore-and-aft balancing of the bow 10, for allowing clearance of various cables, limbs, pulleys, or accessories, or for any other reason. Either or both of transverse or longitudinal adjustment can be employed to reduce vibrations when the bow is shot, e.g., by avoiding quiver positions that result in unintended and undesirable mechanical resonances. Either or both of transverse or longitudinal adjustment can be employed for achieving a user-specific ergonomic arrangement of the stored arrows 99 relative to the riser 14 of the bow 10. While the adjustable quiver often can be arranged so that the stored arrows 99 are substantially vertical, independent adjustment of the upper and lower quiver assemblies 100 and 200 can enable quiver arrangements in which the stored arrows 99 deviate from vertical according to a user's preference.

Vertical adjustment of the positions of one or both arrow retainers 110 or 210 can be employed to alter the vertical position of the stored arrows 99 relative to the riser 14 according to a user's preference, so that the lower ends (i.e., typically the nock ends) of the stored arrows 99 do not extend below the lower limb 12, or for any other reason. Vertical adjustment of one or both arrow retainers 110 or 210 can be employed to alter the distance between the arrow retainers 110 and 210. That span adjustment can enable arrows 99 of different length to be stored in the quiver, or can be adjusted to reduce vibrations when the bow is shot, e.g., by avoiding unintended and undesirable mechanical resonances.

Each arrow retainer 110 or 210 can be of any suitable type or arrangement. In the example shown in the drawings the lower arrow retainer 210 is in the form of multiple flexible protruding fingers forming notches therebetween (e.g., as in U.S. Pat. No. 8,839,773 incorporated above); the shaft of an arrow 99 is inserted between adjacent fingers into a notch and held there by friction arising from deformation of the fingers. In some examples the holding force can be adjusted, or different arrow shaft sizes can be accommodated, by turning screws to press wedged members between adjacent pairs of fingers. Insertion of a wedged member further in between adjacent fingers results in a tighter grip on the shaft of the arrow 99 inserted into the corresponding adjacent notches. In some examples the upper arrow retainer 110 can be arranged in a similar manner.

In the examples shown the upper arrow retainer includes an arrow hood 112. The arrow hood 112 serves to protect the heads of the stored arrows 99 (e.g., broadhead arrow heads) from the surroundings or to protect the user from the arrowheads. In the examples shown the arrow hood 112 also serves as the upper arrow retainer 110, with the arrowheads retained within the arrow hood 112 in any suitable way (e.g., foam insert). In other examples, the upper quiver assembly 100 can include an arrow hood 112 that is a structure separate and distinct from the upper arrow retainer 110. In such examples the upper arrow retainer 110 can be arranged in any suitable way for retaining the arrows 99, including the arrangement described above for the lower arrow retainer 210.

Figure 3A:
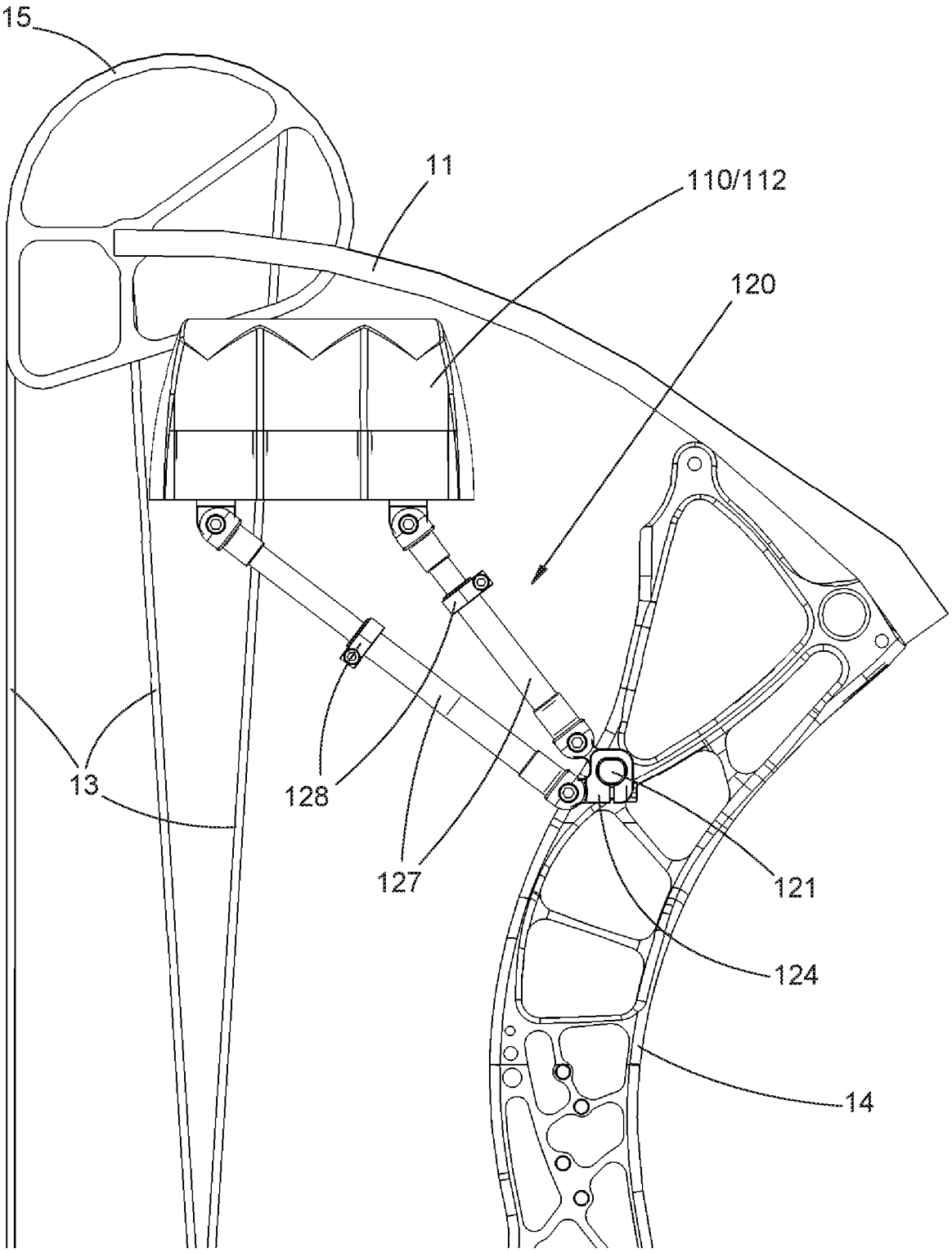
FIGS. 3A, 3B, and 3C are side, front oblique, and front views, respectively, of an example of an upper quiver assembly attached to a riser of a bow. Arrows are present in FIG. 3B.
Figure 3B:
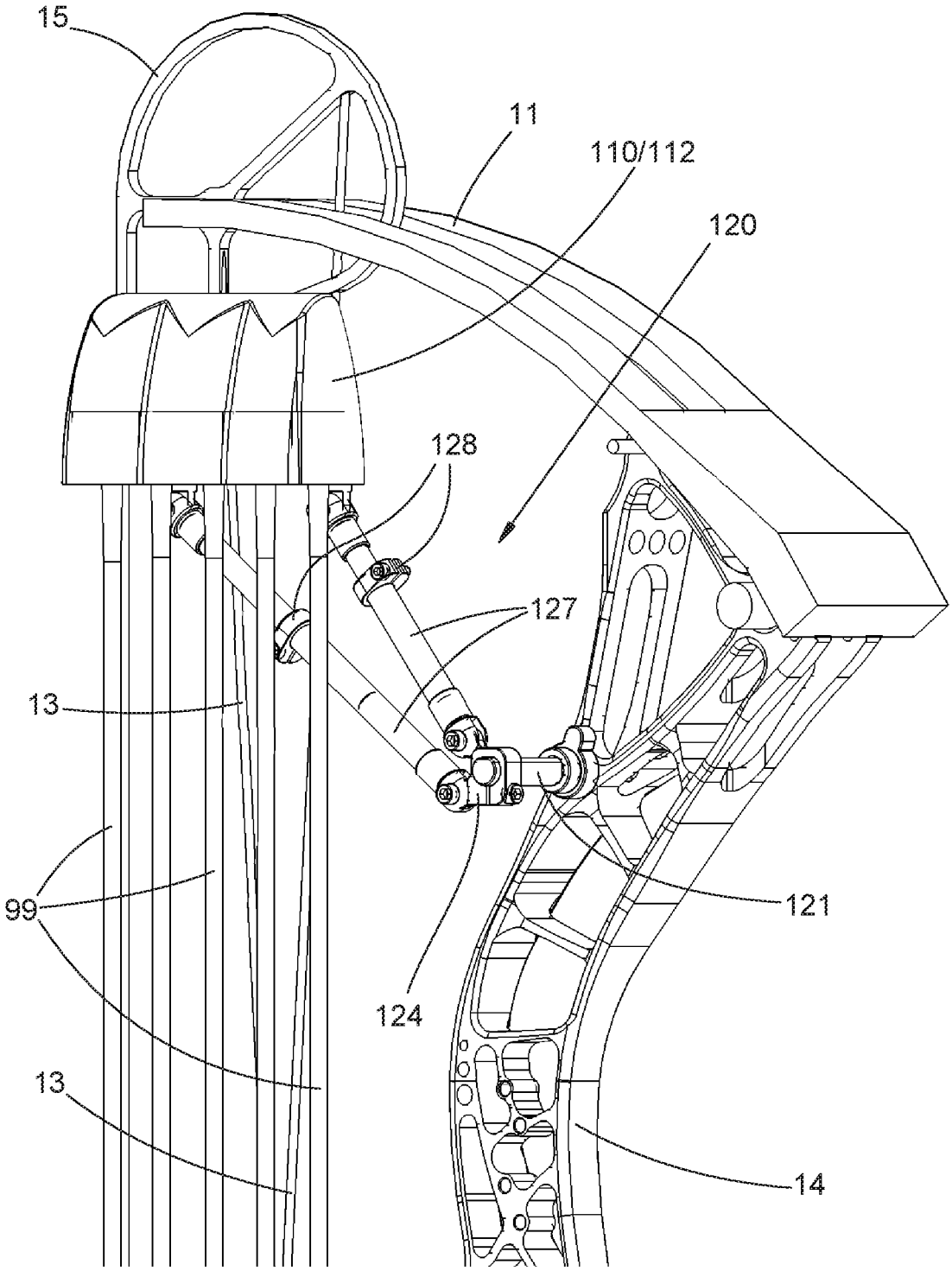
Figure 3C:
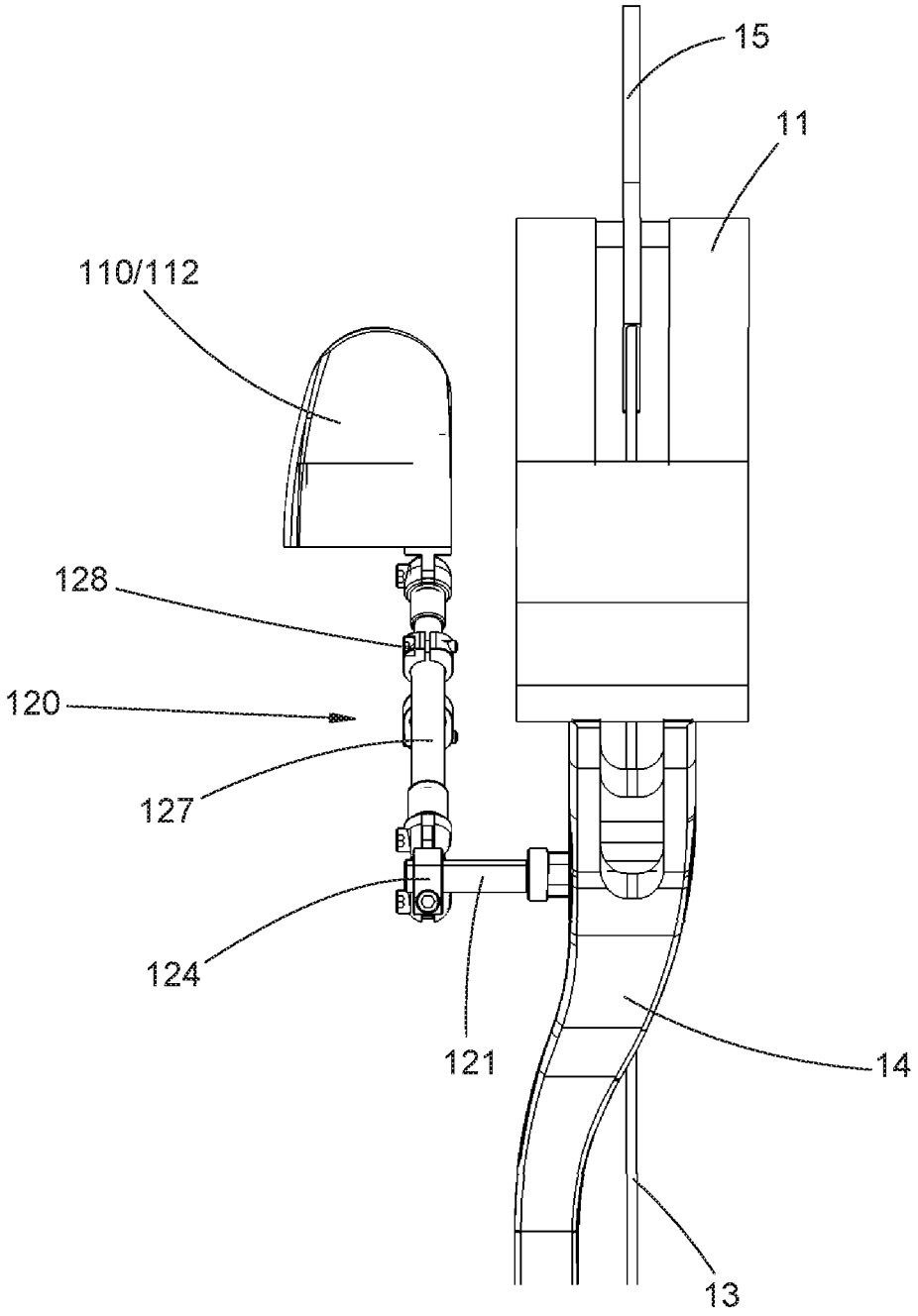
Figure 4A:
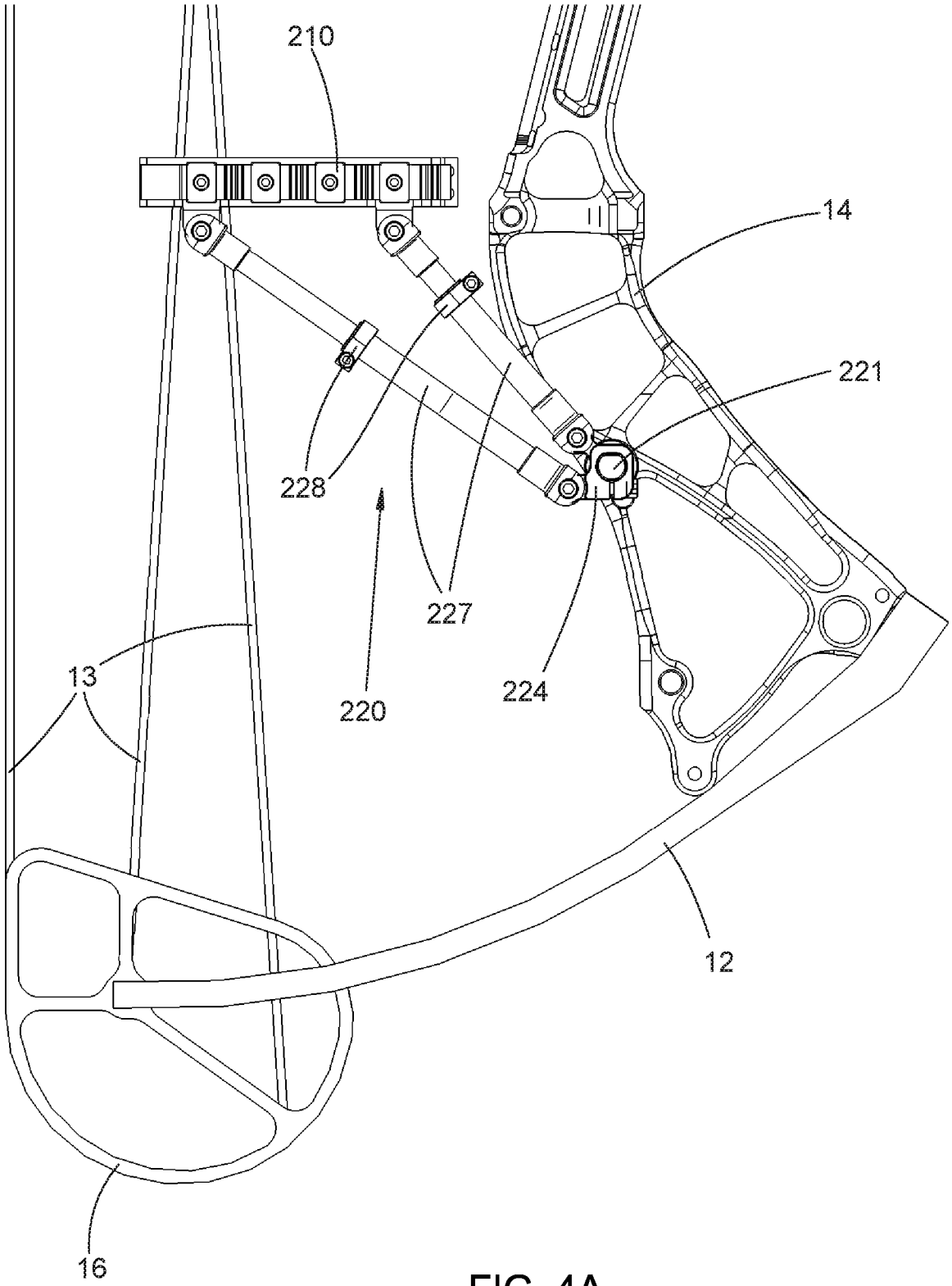
FIGS. 4A, 4B, and 4C are side, front oblique, and front views, respectively, of an example of a lower quiver assembly attached to a riser of a bow. Arrows are present in FIG. 4B.
Figure 4B:
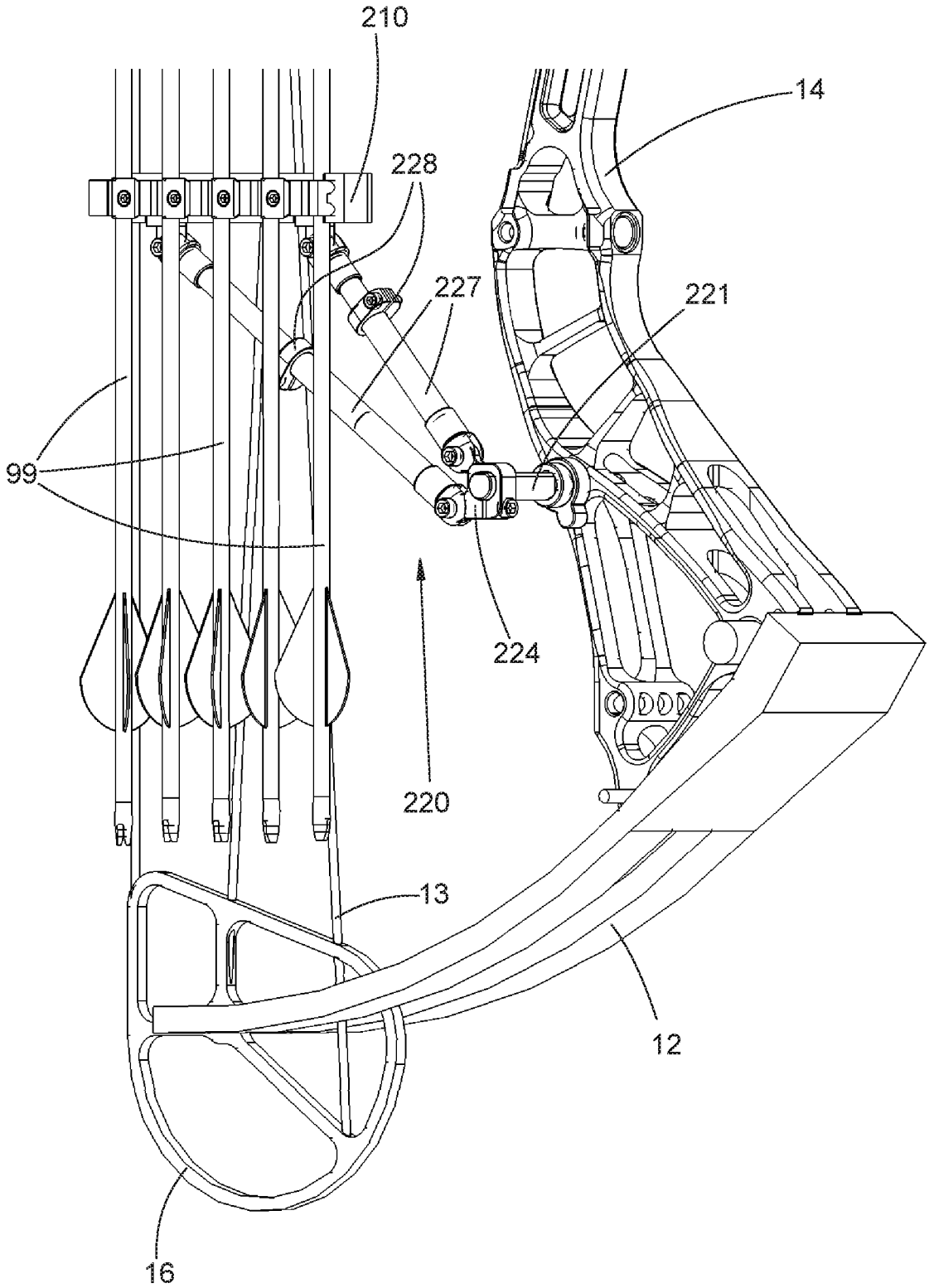
Figure 4C:
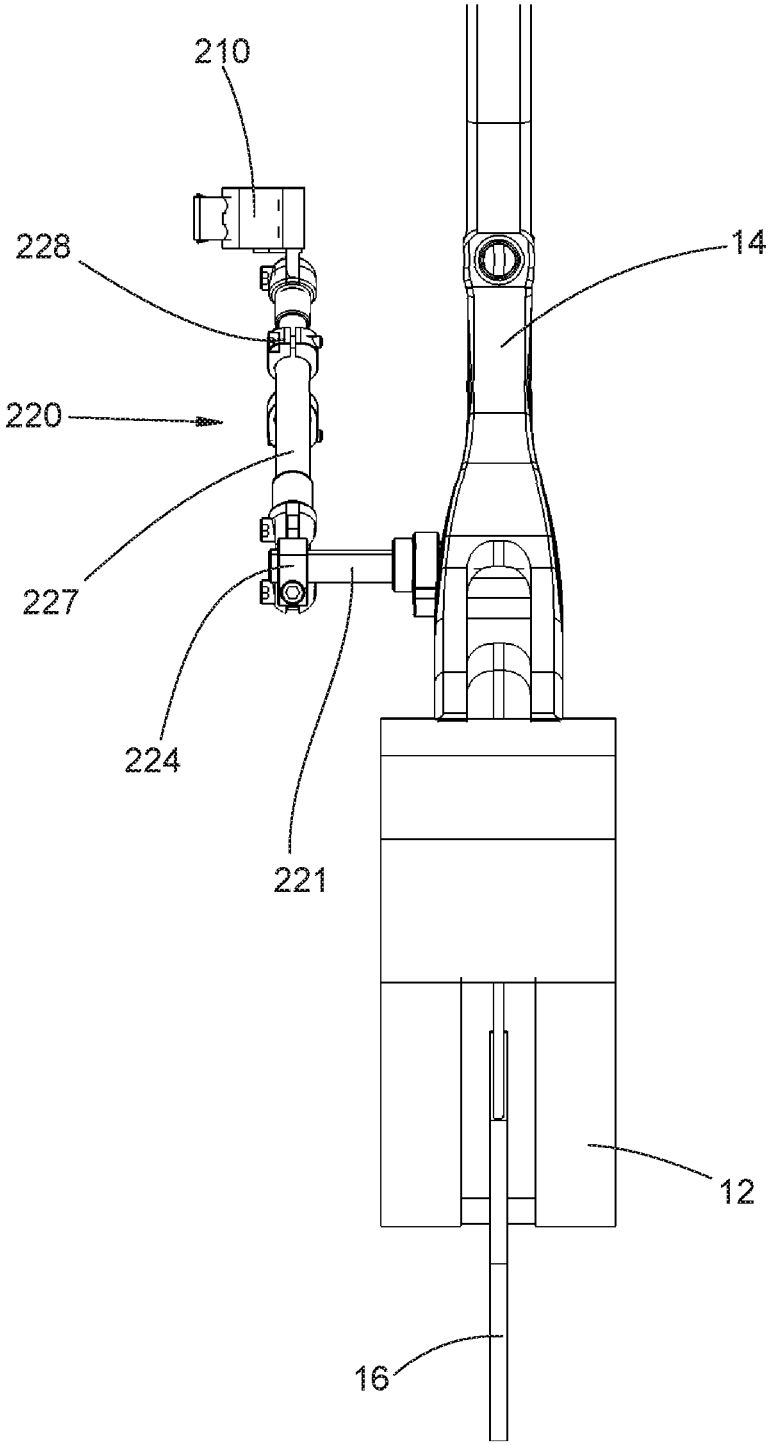
Figure 5E:
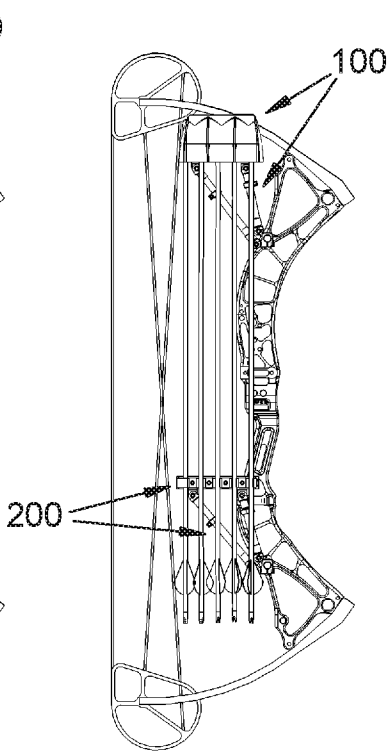
FIGS. 5A through 5E show side views of an example quiver mounted in different longitudinal and vertical positions relative to the riser of the bow.
Figure 5D:
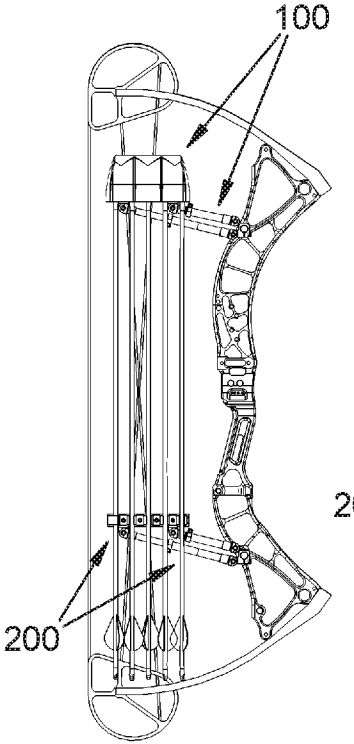
Figure 5C:
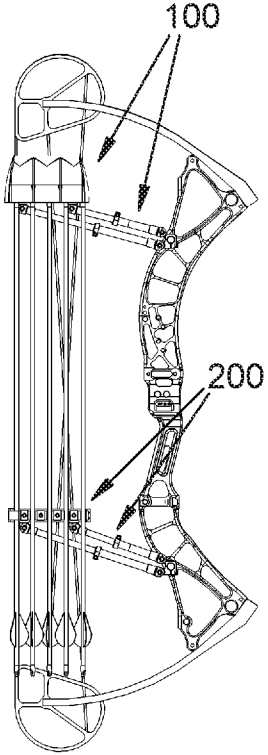
Figure 5B:
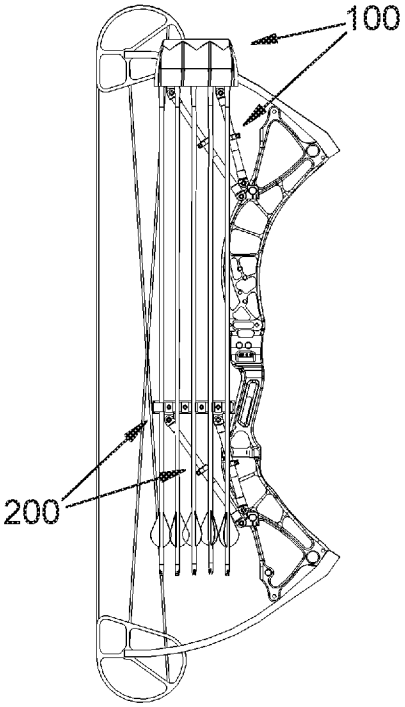
Figure 5A:
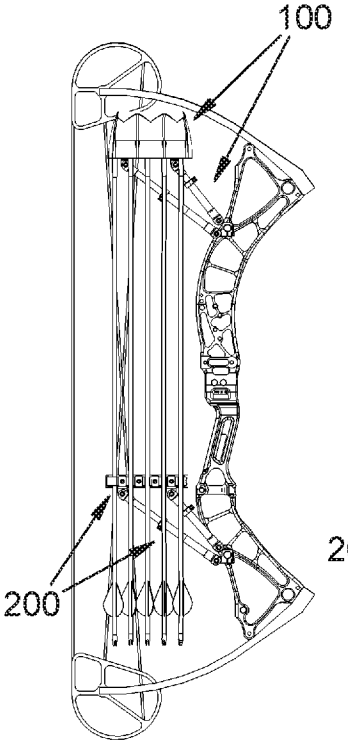

FIGS. 3A-3C show an example of the upper quiver assembly 100, including the upper mounting assembly 120 and the arrow hood 112 serving as the upper arrow retainer 110. FIGS. 4A-4C show an example of the lower quiver assembly 200, including the lower arrow retainer 210 and the lower mounting assembly 220. The upper mounting assembly 120 can include one or more upper telescoping members 127. Each upper telescoping member 127 can be pivotably connected at its proximal end to the riser 14 and pivotably connected at its distal end to the upper arrow retainer 110. Similarly, the lower mounting assembly 220 can include one or more lower telescoping members 227. Each lower telescoping member 227 can be pivotably connected at its proximal end to the riser 14 and pivotably connected at its distal end to the lower arrow retainer 210.

The upper and lower quiver assemblies 100 and 200 each can be arranged in any suitable way so that each telescoping member 127 or 227 can be (i) substantially rigidly secured in corresponding selected relative orientations with respect to the riser and with respect to the corresponding arrow retainer and (ii) substantially rigidly secured at a corresponding selected length. In some examples, including those shown in the drawings, clamps 128 and 228 can be employed to enable the corresponding telescoping members 127 and 227 to be substantially rigidly secured at a selected length. The clamps 128 and 228 can be loosened to allow adjustment of the lengths of the telescoping members 127 and 227 and then retightened. In some examples, including those shown in the drawings, each pivotable connection at each end of each telescoping member 127 or 227 can be arranged as a corresponding tang-and-clevis joint. Each such joint can include a corresponding threaded pin arranged to secure the corresponding joint substantially rigidly at a corresponding selected relative orientation. The threaded pin can be loosened to allow adjustment of the orientation of the corresponding telescoping member 127 or 227 relative to the riser 14 or the corresponding arrow retainer 110 or 210 and then retightened.

In some examples, including those shown in the drawings, the upper mounting assembly 120 includes an upper transverse axle 121 substantially rigidly connected to and extending transversely from the riser 14, and an upper coupler 124. The upper coupler 124 is mounted with the upper transverse axle 121 passing through a hole through the upper coupler 124; the upper coupler 124 is rotatable about and transversely slidable along the upper axle 121. The upper coupler 124 can be arranged to clamp onto the axle 121, so that the upper coupler 124 is substantially rigidly secured to the upper axle 121 at a selected orientation and transverse position relative to the riser 14. Each upper telescoping member 127 can be connected to the riser 14 by being connected to the upper coupler 124. The lower mounting assembly 220 can similarly include a lower transverse axle 221 and a lower coupler 224 arranged as described above, with each lower telescoping member 227 connected to the riser 14 by being connected to the lower coupler 224.

The arrangement of the axles 121 and 221 and corresponding couplers 124 and 224 enables the quiver to be readily removed from and reinstalled on the bow 10. With the couplers 124 and 224 loosened, they can simply slide off of the corresponding axles 121 and 221 to remove the upper and lower quiver assemblies 100 and 200 from the bow 10. When desired, the axles 121 and 221 can be reinserted through the holes through the couplers 124 and 224, which can slide along the corresponding axles 121 and 221 and be substantially rigidly secured at the desired transverse positions and orientations relative to the riser 14. Easy removal and remounting of the quiver assemblies 100 and 200 can facilitate packing, storage, or transport of the bow 10 and the quiver.

In the examples shown, the upper mounting assembly 120 includes two upper telescoping members 127. Each of those upper telescoping members 127 can be pivotably connected at its distal end to the upper arrow retainer 110 at corresponding distinct, spaced-apart connection points. Similarly, in the examples shown, the lower mounting assembly 220 includes two lower telescoping members 227. Each of those lower telescoping members 227 can be pivotably connected at its distal end to the lower arrow retainer 210 at corresponding distinct, spaced-apart connection points.

Figure 6A:
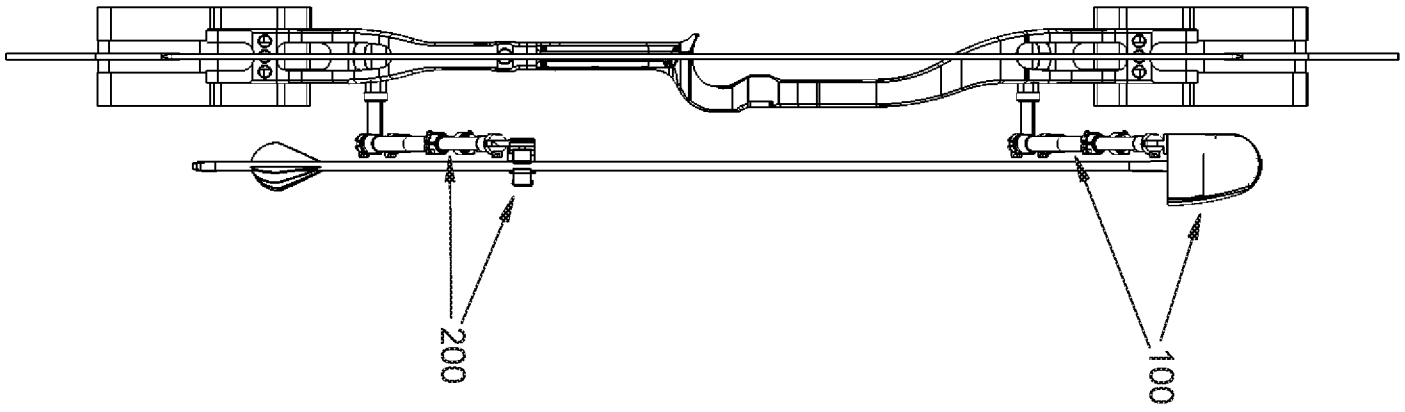
FIGS. 6A and 6B show back views of an example quiver mounted in different transverse positions relative to the riser of the bow.
Figure 6B:
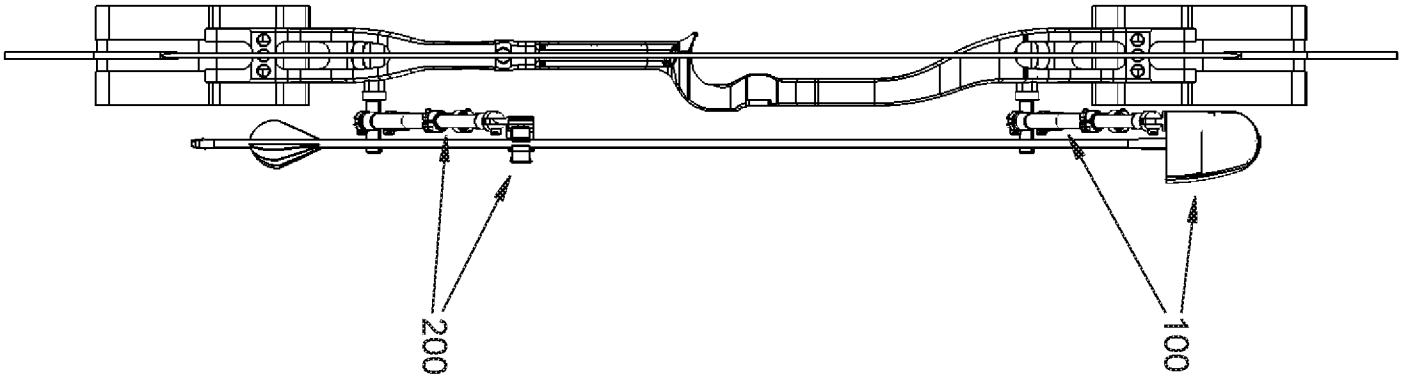

The arrangement of the upper and lower quiver assemblies 100 and 200 enables (i) adjustment of the quiver's position relative to the riser 14, transversely or longitudinally, in some examples vertically, in some examples any two, or in some examples all three, or (ii) in some examples adjustment of the vertical separation between the arrow retainers 110 and 210. First, with the upper and lower arrow retainers 110 and 210 substantially rigidly attached to the riser 14 in corresponding first upper and lower arrow retainer positions, the upper and lower quiver assemblies 100 and 200 are released to permit movement of the corresponding upper and lower arrow retainers 110 and 210 relative to the riser 14. In the examples shown, releasing the quiver assemblies 100 and 200 includes loosening the clamps 128 and 228 on the telescoping members 127 and 227, loosening the couplers 124 and 224, and loosening the tang-and-clevis joints at the ends of the telescoping members 127 and 227. With the quiver assemblies 100 and 200 thus released, the arrow retainers 110 and 210 can be moved to corresponding second arrow retainer positions. Each second arrow retainer position can differ from the corresponding first arrow retainer position longitudinally or transversely, in some examples vertically, in some examples any two, or in some examples all three. With the upper and lower arrow retainers 110 and 210 in the corresponding second upper and lower arrow retainer positions, the upper and lower quiver assemblies 100 and 200 can be secured (e.g., in the example shown by retightening the clamps 128 and 228, couplers 124 and 224, and tang-and-clevis joints) to substantially rigidly attach the arrow retainers 110 and 210 to the riser 14. FIGS. 5A through 5E show examples of different adjustments of the longitudinal and vertical positions of the arrow retainers 110 and 210; FIGS. 6A and 6B show examples of different adjustments of the transverse positions of the arrow retainers 110 and 210.

In addition to the preceding, the following example embodiments fall within the scope of the present disclosure or appended claims:

Example 1

An archery quiver comprising: (a) an upper quiver assembly including an upper arrow retainer and an upper mounting assembly connecting the upper arrow retainer to the riser, the upper arrow retainer being structurally arranged so as to retain each one of multiple arrows stored in the quiver, the upper quiver assembly being structurally arranged so as to enable the upper arrow retainer to be substantially rigidly attached to a riser of an archery bow and held in an upper arrow retainer position that is adjustable over a corresponding range of different longitudinal positions or a corresponding range of different transverse positions relative to the riser; and (b) a lower quiver assembly including a lower arrow retainer and a lower mounting assembly connecting the lower arrow retainer to the riser, the lower arrow retainer being structurally arranged so as to retain each one of the multiple arrows stored in the quiver, the lower quiver assembly being structurally arranged so as to enable the lower arrow retainer to be substantially rigidly attached to the riser of the archery bow and held in a lower arrow retainer position that is (i) adjustable over a corresponding range of different longitudinal positions or a corresponding range of different transverse positions relative to the riser and, (ii) with the archery bow held with the riser in a substantially vertical orientation, below the upper quiver assembly.

Example 2

The archery quiver of Example 1 wherein: (a) the upper quiver assembly is further structurally arranged so that the upper arrow retainer position is adjustable over corresponding ranges of different longitudinal positions and different transverse positions relative to the riser; and (b) the lower quiver assembly is further structurally arranged so that the lower arrow retainer position is adjustable over corresponding ranges of different longitudinal positions and different transverse positions relative to the riser.

Example 3

The archery quiver of any one of Examples 1 or 2 wherein: (a) the upper quiver assembly is further structurally arranged so that the upper arrow retainer position is adjustable over a corresponding range of different vertical positions relative to the riser; or (b) the lower quiver assembly is further structurally arranged so that the lower arrow retainer position is adjustable over a corresponding range of different vertical positions relative to the riser.

Example 4

The archery quiver of any one of Examples 1 through 3 wherein the upper quiver assembly includes an arrow hood.

Example 5

The archery quiver of Example 4 wherein the arrow hood serves as the upper arrow retainer.

Example 6

The archery quiver of Example 4 wherein the arrow hood is arranged as a structure separate and distinct from the upper arrow retainer.

Example 7

The archery quiver of any one of Examples 1 through 6 wherein the upper and lower arrow retainer positions are adjustable independently of one another.

Example 8

The archery quiver of any one of Examples 1 through 7 wherein the upper and lower quiver assemblies comprise separate assemblies that are structurally arranged to be attached independently to the riser at distinct corresponding locations on the riser.

Example 9

The archery quiver of any one of Examples 1 through 8 wherein: (a) the upper mounting assembly includes one or more upper telescoping members, each upper telescoping member being pivotably connected at a proximal end thereof to the riser and pivotably connected at a distal end thereof to the upper arrow retainer; (b) the lower mounting assembly includes one or more lower telescoping members, each lower telescoping member being pivotably connected at a proximal end thereof to the riser and pivotably connected at a distal end thereof to the lower arrow retainer; and (c) the upper and lower quiver assemblies are each arranged so as to enable each telescoping member to be (i) substantially rigidly secured in corresponding selected relative orientations with respect to the riser and with respect to the corresponding arrow retainer and (ii) substantially rigidly secured at a corresponding selected length thereof.

Example 10

The archery quiver of Example 9 wherein: (a) the upper mounting assembly includes an upper transverse axle substantially rigidly connected to and extending transversely from the riser, and an upper coupler being mounted with the upper transverse axle passing through a hole therethrough so that the upper coupler is rotatable about and transversely slidable along the upper axle, each upper telescoping member being connected to the riser by being connected to the upper coupler, the upper coupler being arranged so as to be substantially rigidly secured to the upper axle at a selected orientation and a selected transverse position relative to the riser; and (b) the lower mounting assembly includes a lower transverse axle substantially rigidly connected to and extending transversely from the riser, and a lower coupler being mounted with the lower transverse axle passing through a hole therethrough so that the lower coupler is rotatable about and transversely slidable along the lower axle, each lower telescoping member being connected to the riser by being connected to the lower coupler, the lower coupler being arranged so as to be substantially rigidly secured to the lower axle at a selected orientation and a selected transverse position relative to the riser.

Example 11

The archery quiver of Example 10 wherein the upper coupler is arranged so as to clamp onto the upper axle at a selected orientation and a selected transverse position relative to the riser, and the lower coupler is arranged so as to clamp onto the lower axle at a selected orientation and a selected transverse position relative to the riser.

Example 12

The archery quiver of any one of Examples 9 through 11 wherein: (a) the upper mounting assembly includes two upper telescoping members, each upper telescoping member being pivotably connected at a distal end thereof to the upper arrow retainer at corresponding distinct, spaced-apart connection points thereon; and (b) the lower mounting assembly includes two lower telescoping members, each lower telescoping member being pivotably connected at a distal end thereof to the lower arrow retainer at corresponding distinct, spaced-apart connection points thereon.

Example 13

The archery quiver of any one of Examples 9 through 12 wherein each telescoping member includes a corresponding clamp for substantially rigidly securing the corresponding telescoping member at a selected length thereof.

Example 14

The archery quiver of any one of Examples 9 through 13 wherein each pivotable connection at each end of each elongated member is arranged as a corresponding tang-and-clevis joint that includes a corresponding threaded pin arranged to substantially rigidly secure the corresponding joint at a corresponding selected relative orientation.

Example 15

The archery quiver of any one of Examples 1 through 14 wherein one or both of the upper or lower arrow retainers includes adjustable tension for retaining arrows stored in the quiver.

Example 16

A method for adjusting the archery quiver of any one of Examples 3 through 15, the method comprising: (A) with the upper arrow retainer substantially rigidly attached to the riser in a first upper arrow retainer position, releasing the upper quiver assembly to permit movement of the upper arrow retainer relative to the riser; (B) moving the upper arrow retainer to a second upper arrow retainer position that is displaced vertically relative to the first upper arrow retainer position; and (C) securing the upper quiver assembly to attach the upper arrow retainer substantially rigidly to the riser in the second upper arrow retainer position.

Example 17

A method for adjusting the archery quiver of any one of Examples 3 through 15, the method comprising: (A) with the lower arrow retainer substantially rigidly attached to the riser in a first lower arrow retainer position, releasing the lower quiver assembly to permit movement of the lower arrow retainer relative to the riser; (B) moving the lower arrow retainer to a second lower arrow retainer position that is displaced vertically relative to the first lower arrow retainer position; and (C) securing the lower quiver assembly to attach the lower arrow retainer substantially rigidly to the riser in the second lower arrow retainer position.

Example 18

A method for adjusting the archery quiver of any one of Examples 3 through 15, comprising performing the methods of both of Examples 16 and 17.

Example 19

The method of any one of Examples 16 through 18 further comprising: (A) with the upper and lower arrow retainers substantially rigidly attached to the riser in corresponding first upper and lower arrow retainer positions, releasing the upper and lower quiver assemblies to permit movement of the corresponding upper and lower arrow retainers relative to the riser; (B) moving the upper arrow retainer to a second upper arrow retainer position that is displaced longitudinally relative to the first upper arrow retainer position, and moving the lower arrow retainer to a second lower arrow retainer position that is displaced longitudinally relative to the first lower arrow retainer position; and (C) securing the upper and lower quiver assemblies to attach the upper and lower arrow retainers substantially rigidly to the riser in the corresponding second upper and lower arrow retainer positions.

Example 20

The method of any one of Examples 16 through 18 further comprising: (A) with the upper and lower arrow retainers substantially rigidly attached to the riser in corresponding first upper and lower arrow retainer positions, releasing the upper and lower quiver assemblies to permit movement of the corresponding upper and lower arrow retainers relative to the riser; (B) moving the upper arrow retainer to a second upper arrow retainer position that is displaced longitudinally relative to the first upper arrow retainer position, and moving the lower arrow retainer to a second lower arrow retainer position that is displaced transversely relative to the first lower arrow retainer position; and (C) securing the upper and lower quiver assemblies to attach the upper and lower arrow retainers substantially rigidly to the riser in the corresponding second upper and lower arrow retainer positions.

Example 21

A method for adjusting the archery quiver of any one of Examples 3 through 15, comprising performing the methods of both of Examples 19 and 20.

Example 22

A method for adjusting the archery quiver of any one of Examples 1 through 15, the method comprising: (A) with the upper and lower arrow retainers substantially rigidly attached to the riser in corresponding first upper and lower arrow retainer positions, releasing the upper and lower quiver assemblies to permit movement of the corresponding upper and lower arrow retainers relative to the riser; (B) moving the upper arrow retainer to a second upper arrow retainer position that is displaced longitudinally relative to the first upper arrow retainer position, and moving the lower arrow retainer to a second lower arrow retainer position that is displaced longitudinally relative to the first lower arrow retainer position; and (C) securing the upper and lower quiver assemblies to attach the upper and lower arrow retainers substantially rigidly to the riser in the corresponding second upper and lower arrow retainer positions.

Example 23

A method for adjusting the archery quiver of any one of Examples 1 through 15, the method comprising: (A) with the upper and lower arrow retainers substantially rigidly attached to the riser in corresponding first upper and lower arrow retainer positions, releasing the upper and lower quiver assemblies to permit movement of the corresponding upper and lower arrow retainers relative to the riser; (B) moving the upper arrow retainer to a second upper arrow retainer position that is displaced longitudinally relative to the first upper arrow retainer position, and moving the lower arrow retainer to a second lower arrow retainer position that is displaced transversely relative to the first lower arrow retainer position; and (C) securing the upper and lower quiver assemblies to attach the upper and lower arrow retainers substantially rigidly to the riser in the corresponding second upper and lower arrow retainer positions.

Example 24

A method for adjusting the archery quiver of any one of Examples 1 through 15, comprising performing the methods of both of Examples 22 and 23.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore, the present disclosure shall be construed as implicitly disclosing any embodiment having any suitable subset of one or more features—which features are shown, described, or claimed in the present application—including those subsets that may not be explicitly disclosed herein. A "suitable" subset of features includes only features that are neither incompatible nor mutually exclusive with respect to any other feature of that subset. Accordingly, the appended claims are hereby incorporated in their entirety into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the cumulative scope of the appended claims can, but does not necessarily, encompass the whole of the subject matter disclosed in the present application.

The following interpretations shall apply for purposes of the present disclosure and appended claims. The words "comprising," "including," "having," and variants thereof, wherever they appear, shall be construed as open ended terminology, with the same meaning as if a phrase such as "at least" were appended after each instance thereof, unless explicitly stated otherwise. The article "a" shall be interpreted as "one or more" unless "only one," "a single," or other similar limitation is stated explicitly or is implicit in the particular context; similarly, the article "the" shall be interpreted as "one or more of the" unless "only one of the," "a single one of the," or other similar limitation is stated explicitly or is implicit in the particular context. The conjunction "or" is to be construed inclusively unless: (i) it is explicitly stated otherwise, e.g., by use of "either . . . or," "only one of," or similar language; or (ii) two or more of the listed alternatives are understood or disclosed (implicitly or explicitly) to be incompatible or mutually exclusive within the particular context. In that latter case, "or" would be understood to encompass only those combinations involving non-mutually-exclusive alternatives. In one example, each of "a dog or a cat," "one or more of a dog or a cat," and "one or more dogs or cats" would be interpreted as one or more dogs without any cats, or one or more cats without any dogs, or one or more of each. In another example, each of "a dog, a cat, or a mouse," "one or more of a dog, a cat, or a mouse," and "one or more dogs, cats, or mice" would be interpreted as (i) one or more dogs without any cats or mice, (ii) one or more cats without and dogs or mice, (iii) one or more mice without any dogs or cats, (iv) one or more dogs and one or more cats without any mice, (v) one or more dogs and one or more mice without any cats, (vi) one or more cats and one or more mice without any dogs, or (vii) one or more dogs, one or more cats, and one or more mice. In another example, each of "two or more of a dog, a cat, or a mouse" or "two or more dogs, cats, or mice" would be interpreted as (i) one or more dogs and one or more cats without any mice, (ii) one or more dogs and one or more mice without any cats, (iii) one or more cats and one or more mice without and dogs, or (iv) one or more dogs, one or more cats, and one or more mice; "three or more," "four or more," and so on would be analogously interpreted.

For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, third, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An archery quiver comprising:

(a) an upper quiver assembly including an upper arrow retainer and an upper mounting assembly including at least one upper member pivotably connecting the upper arrow retainer to the riser, the at least one upper member being pivotably connected at a proximal end thereof to the riser and pivotably connected at a distal end thereof to the upper arrow retainer, the upper arrow retainer being structurally arranged so as to retain each one of multiple arrows stored in the quiver, the upper quiver assembly being structurally arranged so as to enable the upper arrow retainer to be substantially rigidly attached to a riser of an archery bow and held in an upper arrow retainer position that is adjustable over a corresponding range of different longitudinal positions or a corresponding range of different transverse positions relative to the riser; and (b) a lower quiver assembly including a lower arrow retainer and a lower mounting assembly including at least one lower member pivotably connecting the lower arrow retainer to the riser, the at least one lower member being pivotably connected at a proximal end thereof to the riser and pivotably connected at a distal end thereof to the lower arrow retainer, the lower arrow retainer being structurally arranged so as to retain each one of the multiple arrows stored in the quiver, the lower quiver assembly being structurally arranged so as to enable the lower arrow retainer to be substantially rigidly attached to the riser of the archery bow and held in a lower arrow retainer position that is (i) adjustable over a corresponding range of different longitudinal positions or a corresponding range of different transverse positions relative to the riser and, (ii) with the archery bow held with the riser in a substantially vertical orientation, below the upper quiver assembly.

2. The archery quiver of claim 1 wherein:

(a) the upper quiver assembly is further structurally arranged so that the upper arrow retainer position is adjustable over corresponding ranges of different longitudinal positions and different transverse positions relative to the riser; and (b) the lower quiver assembly is further structurally arranged so that the lower arrow retainer position is adjustable over corresponding ranges of different longitudinal positions and different transverse positions relative to the riser.

3. A method for adjusting the archery quiver of claim 1, the method comprising:

(A) with the upper and lower arrow retainers substantially rigidly attached to the riser in corresponding first upper and lower arrow retainer positions, releasing the upper and lower quiver assemblies to permit movement of the corresponding upper and lower arrow retainers relative to the riser;

(B) moving the upper arrow retainer to a second upper arrow retainer position that is displaced longitudinally relative to the first upper arrow retainer position, and moving the lower arrow retainer to a second lower arrow retainer position that is displaced longitudinally relative to the first lower arrow retainer position; and (C) securing the upper and lower quiver assemblies to attach the upper and lower arrow retainers substantially rigidly to the riser in the corresponding second upper and lower arrow retainer positions.

4. A method for adjusting the archery quiver of claim 1, the method comprising:

(A) with the upper and lower arrow retainers substantially rigidly attached to the riser in corresponding first upper and lower arrow retainer positions, releasing the upper and lower quiver assemblies to permit movement of the corresponding upper and lower arrow retainers relative to the riser;

(B) moving the upper arrow retainer to a second upper arrow retainer position that is displaced longitudinally relative to the first upper arrow retainer position, and moving the lower arrow retainer to a second lower arrow retainer position that is displaced transversely relative to the first lower arrow retainer position; and (C) securing the upper and lower quiver assemblies to attach the upper and lower arrow retainers substantially rigidly to the riser in the corresponding second upper and lower arrow retainer positions.

5. The archery quiver of claim 1 wherein:

(a) the upper quiver assembly is further structurally arranged so that the upper arrow retainer position is adjustable over a corresponding range of different vertical positions relative to the riser; or (b) the lower quiver assembly is further structurally arranged so that the lower arrow retainer position is adjustable over a corresponding range of different vertical positions relative to the riser.

6. A method for adjusting the archery quiver of claim 5, the method comprising:

(A) with the upper arrow retainer substantially rigidly attached to the riser in a first upper arrow retainer position, releasing the upper quiver assembly to permit movement of the upper arrow retainer relative to the riser;

(B) moving the upper arrow retainer to a second upper arrow retainer position that is displaced vertically relative to the first upper arrow retainer position; and (C) securing the upper quiver assembly to attach the upper arrow retainer substantially rigidly to the riser in the second upper arrow retainer position.

7. A method for adjusting the archery quiver of claim 5, the method comprising:

(A) with the lower arrow retainer substantially rigidly attached to the riser in a first lower arrow retainer position, releasing the lower quiver assembly to permit movement of the lower arrow retainer relative to the riser;

(B) moving the lower arrow retainer to a second lower arrow retainer position that is displaced vertically relative to the first lower arrow retainer position; and (C) securing the lower quiver assembly to attach the lower arrow retainer substantially rigidly to the riser in the second lower arrow retainer position.

8. The archery quiver of claim 1 wherein the upper quiver assembly includes an arrow hood.

9. The archery quiver of claim 8 wherein the arrow hood serves as the upper arrow retainer.

10. The archery quiver of claim 8 wherein the arrow hood is arranged as a structure separate and distinct from the upper arrow retainer.

11. The archery quiver of claim 1 wherein the upper and lower arrow retainer positions are adjustable independently of one another.

12. The archery quiver of claim 1 wherein the upper and lower quiver assemblies comprise separate assemblies that are structurally arranged to be attached independently to the riser at distinct corresponding locations on the riser.

13. The archery quiver of claim 1 wherein:

(a) the at least one upper member of the upper mounting assembly includes one or more upper telescoping members;

(b) the at least one lower member of the lower mounting assembly includes one or more lower telescoping members; and (c) the upper and lower quiver assemblies are each arranged so as to enable each telescoping member to be (i) substantially rigidly secured in corresponding selected relative orientations with respect to the riser and with respect to the corresponding arrow retainer and (ii) substantially rigidly secured at a corresponding selected length thereof.

14. The archery quiver of claim 13 wherein:

(a) the upper mounting assembly includes an upper transverse axle substantially rigidly connected to and extending transversely from the riser, and an upper coupler being mounted with the upper transverse axle passing through a hole therethrough so that the upper coupler is rotatable about and transversely slidable along the upper axle, each upper telescoping member being connected to the riser by being connected to the upper coupler, the upper coupler being arranged so as to be substantially rigidly secured to the upper axle at a selected orientation and a selected transverse position relative to the riser; and (b) the lower mounting assembly includes a lower transverse axle substantially rigidly connected to and extending transversely from the riser, and a lower coupler being mounted with the lower transverse axle passing through a hole therethrough so that the lower coupler is rotatable about and transversely slidable along the lower axle, each lower telescoping member being connected to the riser by being connected to the lower coupler, the lower coupler being arranged so as to be substantially rigidly secured to the lower axle at a selected orientation and a selected transverse position relative to the riser.

15. The archery quiver of claim 14 wherein the upper coupler is arranged so as to clamp onto the upper axle at a selected orientation and a selected transverse position relative to the riser, and the lower coupler is arranged so as to clamp onto the lower axle at a selected orientation and a selected transverse position relative to the riser.

16. The archery quiver of claim 13 wherein:

(a) the upper mounting assembly includes two upper telescoping members, each upper telescoping member being pivotably connected at a distal end thereof to the upper arrow retainer at corresponding distinct, spaced-apart connection points thereon; and (b) the lower mounting assembly includes two lower telescoping members, each lower telescoping member being pivotably connected at a distal end thereof to the lower arrow retainer at corresponding distinct, spaced-apart connection points thereon.

17. The archery quiver of claim 13 wherein each telescoping member includes a corresponding clamp for substantially rigidly securing the corresponding telescoping member at a selected length thereof.

18. The archery quiver of claim 13 wherein each pivotable connection at each end of each elongated member is arranged as a corresponding tang-and-clevis joint that includes a corresponding threaded pin arranged to substantially rigidly secure the corresponding joint at a corresponding selected relative orientation.

19. The archery quiver of claim 1 wherein one or both of the upper or lower arrow retainers includes adjustable tension for retaining arrows stored in the quiver.

20. An archery quiver comprising:

(a) an upper quiver assembly including an upper arrow retainer and an upper mounting assembly including an upper telescoping member connecting the upper arrow retainer to the riser, the upper arrow retainer being structurally arranged so as to retain each one of multiple arrows stored in the quiver, the upper telescoping member being structurally arranged so as to enable the upper arrow retainer to be substantially rigidly attached to a riser of an archery bow and held in an upper arrow retainer position that is adjustable over a corresponding range of different longitudinal positions or a corresponding range of different transverse positions relative to the riser; and (b) a lower quiver assembly including a lower arrow retainer and a lower mounting assembly including a lower telescoping member connecting the lower arrow retainer to the riser, the lower arrow retainer being structurally arranged so as to retain each one of the multiple arrows stored in the quiver, the lower telescoping member being structurally arranged so as to enable the lower arrow retainer to be substantially rigidly attached to the riser of the archery bow and held in a lower arrow retainer position that is (i) adjustable over a corresponding range of different longitudinal positions or a corresponding range of different transverse positions relative to the riser and, (ii) with the archery bow held with the riser in a substantially vertical orientation, below the upper quiver assembly.

21. An archery quiver comprising:

(a) an upper quiver assembly including an upper arrow retainer and an upper mounting assembly including one or more upper telescoping members connecting the upper arrow retainer to the riser, each upper telescoping member being pivotably connected at a proximal end thereof to the riser and pivotably connected at a distal end thereof to the upper arrow retainer, the upper arrow retainer being structurally arranged so as to retain each one of multiple arrows stored in the quiver, the upper quiver assembly being structurally arranged so as to enable the upper arrow retainer to be substantially rigidly attached to a riser of an archery bow and held in an upper arrow retainer position that is adjustable over a corresponding range of different longitudinal positions or a corresponding range of different transverse positions relative to the riser; and (b) a lower quiver assembly including a lower arrow retainer and a lower mounting assembly including one or more lower telescoping members connecting the lower arrow retainer to the riser, each lower telescoping member being pivotably connected at a proximal end thereof to the riser and pivotably connected at a distal end thereof to the lower arrow retainer, the lower arrow retainer being structurally arranged so as to retain each one of the multiple arrows stored in the quiver, the lower quiver assembly being structurally arranged so as to enable the lower arrow retainer to be substantially rigidly attached to the riser of the archery bow and held in a lower arrow retainer position that is (i) adjustable over a corresponding range of different longitudinal positions or a corresponding range of different transverse positions relative to the riser and, (ii) with the archery bow held with the riser in a substantially vertical orientation, below the upper quiver assembly;

(c) wherein the upper and lower quiver assemblies are each arranged so as to enable each telescoping member to be (i) substantially rigidly secured in corresponding selected relative orientations with respect to the riser and with respect to the corresponding arrow retainer and (ii) substantially rigidly secured at a corresponding selected length thereof.

* * * * *